US007422394B2

(12) United States Patent
Koon et al.

(10) Patent No.: US 7,422,394 B2
(45) Date of Patent: Sep. 9, 2008

(54) TENDON FOR TENSION LEG PLATFORM

(75) Inventors: James R. Koon, Katy, TX (US); Pieter G. Wybro, Katy, TX (US); Robert M. Kipp, Fulshear, TX (US)

(73) Assignees: Modec International, Inc., Houston, TX (US); Sea Engineering, Inc., Katy, TX (US)

( * ) Notice: Subject to any disclaimer, the term of this patent is extended or adjusted under 35 U.S.C. 154(b) by 176 days.

(21) Appl. No.: 11/383,350

(22) Filed: May 15, 2006

(65) Prior Publication Data

US 2007/0264086 A1 Nov. 15, 2007

(51) Int. Cl.
*B63B 35/44* (2006.01)

(52) U.S. Cl. ..... 405/223.1; 405/224

(58) Field of Classification Search ..... 405/223.1, 405/224, 224.2–224.4
See application file for complete search history.

(56) References Cited

U.S. PATENT DOCUMENTS 4,297,965 A 11/1981 Horton et al.
4,784,529 A * 11/1988 Hunter ..... 405/223.1
5,118,221 A 6/1992 Copple
5,174,687 A * 12/1992 Dunlop et al. ..... 405/223.1
5,443,330 A 8/1995 Copple
5,447,392 A * 9/1995 Marshall ..... 405/223.1
5,683,206 A 11/1997 Copple
6,682,266 B2 1/2004 Karal et al.
6,851,894 B1 2/2005 Perret et al.
7,140,807 B2 * 11/2006 Liao et al. ..... 405/223.1
7,163,356 B2 * 1/2007 Huang et al. ..... 405/223.1
2005/0019102 A1 1/2005 Copple et al.
2005/0238439 A1 10/2005 Huang et al.
2005/0244231 A1 * 11/2005 Liao et al. ..... 405/223.1
2006/0210362 A1 * 9/2006 Wybro et al. ..... 405/223.1

* cited by examiner

*Primary Examiner*—Frederick L Lagman
(74) *Attorney, Agent, or Firm*—Gary L. Bush; Brett T. Cooke; Andrews Kurth LLP

(57) ABSTRACT

A tendon for mooring a tension leg platform having an uppermost pipe segment with a reduced diameter compared to at least one of the lower pipe segments. The tendon is watertight and sealed from the ocean environment, preferably filled with air at one atmosphere of pressure. One or more interior bulkheads may be included to divide the tendon into multiple compartments. The reduced outer diameter of the uppermost pipe segment provides reduced drag due to waves and currents and accommodates smaller tendon support buoys and vortex fairings, while the greater diameter of the lower pipe segment provides for increased tendon buoyancy.

19 Claims, 5 Drawing Sheets

TENDON FOR TENSION LEG PLATFORM

BACKGROUND OF THE INVENTION

1. Field of the Invention

This invention relates generally to tension leg platforms for deep-sea hydrocarbon production and specifically to mooring tendons therefor.

2. Description of the Prior Art

Tension leg platforms (TLPs) are increasingly used for exploitation of deep sea hydrocarbon reserves. A TLP is a semi-submersible floating platform anchored to a foundation on the sea bed by mooring elements, often called tension legs, tethers, or tendons. The tendons are maintained in tension at all times by ensuring net positive TLP buoyancy under all environmental conditions. The tendons stiffly restrain the TLP against vertical offset, essentially preventing heave, pitch and roll, yet they compliantly restrain the TLP against lateral offset, allowing limited surge, sway and yaw.

As shown in FIG. 1, the TLP has a submerged hull (14). The hull has a keel (24) and a top (48). The hull (14) has one or more vertical columns (20) extending upwards thereon that penetrate the surface of the water when the TLP is at installed draft. The columns generally support an integrated platform superstructure (not illustrated), which consists of one or more decks for drilling, production and processing equipment, support structures, and human use.

Each hull (14) is designed to mate with a number of tendons (12) at tendon porches located near the keel (24). The tendon porches contain connection sleeves (22) to receive and clamp tendons at the length adjustment joint (LAJ) (27), which are located at upper ends of the tendons (12). The connection sleeves (22) are often ring-shaped, requiring vertical entry of the tendons, or are slotted, allowing side entry of the tendons. The tendons (12) are usually made of hollow steel pipes. Steel pipe tendons are frequently watertight and internally sealed from the sea environment, filled with air at atmospheric pressure at sea level to reduce their weight in water and the resultant loading on the TLP. The tendons (12) terminate at their lower ends with bottom latch assemblies (50). The bottom latch assemblies form "stab" connectors that are received and locked into pilings (52) in a seabed foundation structure (54). The bottom latch assemblies (50) are usually designed to allow some tendon pivoting with respect to the foundation structure to accommodate limited lateral motion of the TLP due to wind, waves and currents.

The tendons (12) often accommodate tendon support buoys (TSBs) (30), which are temporarily secured to upper portions of the tendons to provide positive buoyancy and maintain the tendons in a vertical orientation prior to and during TLP installation. After the TLP is locked-off to the tendons and de-ballasted to tension the tendons, the TSBs are usually neither required nor desired to be carried on the tendons, as they increase wave loading on the TLP.

Tendons are subject to a number of competing design criteria, including considerations such as TLP size and design, expected environmental loads from wind and currents, the amount of allowed set-down and depth of water at the mooring location, the number of mooring tendons, tendon material, corrosion effects, and cost concerns. Aside from these considerations, tendon design usually strikes a compromise between the cross-sectional area of the pipe required for tensile strength (which can be expressed in terms of outer diameter and wall thickness), the wall thickness required to withstand bending moments, the ability to withstand external crushing force of the sea pressure at depth (which is a function of the outer diameter to wall thickness ratio, D/t), and buoyancy (which also can be expressed in terms of D/t, where greater D/t results in greater buoyancy and D/t equal to about 30 indicates a neutrally buoyant steel tendon). D/t ratios may thus vary along the length of the tendon (12) to achieve the desired overall tendon characteristics.

As deep water production progresses and the mooring depth increases, the lower portions of the tendons are subjected to increased hydrostatic pressure, which can cause buckling or crushing of the tendon. To prevent tendon failure under high seawater pressures, a strength of materials analysis shows that smaller D/t ratios are required for those portions of the tendon (12) located in deep water. In other words, without changing the tendon, material, tendons require smaller outer diameters and/or greater wall thicknesses. Unfortunately, greater wall thicknesses, coupled with longer length of the tendons, can result in tendon weights that exceed a TLP's support capacity. Larger TLPs may be required to support the heavier tendons, but larger TLPs may not be cost effective.

Alternatively, instead of increasing wall thickness, the lower portions of the tendons can be pressurized to balance the net tendon pressure at depth, as taught by U.S. Pat. No. 4,521,135 issued to Silcox and U.S. Pat. No. 6,682,266 issued to Karal et al., or the interior of the lower portion of the tendons can flooded with seawater in free communication with the exterior environment, as taught by U.S. patent application Ser. No. 4,630,970 issued to Gunderson et al. and U.S. Pat. No. 5,683,206 issued to Copple. Composite and fiber tendons are also known in art that attempt to address the problem associated with heavier tendons as the depth increases. See, for example, U.S. Patent Publication No. 2005/0244231 for Liao et al.

A preferred method for reducing tendon weight is to increase the buoyancy of the tendon, usually by increasing the volume of displaced water. This is often accomplished by strapping permanent buoyancy modules near the tops of the tendons. Alternatively, buoyancy of the tendon may be increased by increasing the tendon outer diameter, usually along the upper portion of the tendon, and in particular, at the of the tops of the tendons. However, it is usually not desirable to increase the diameter of the tendon near the sea floor, where the tendon is subjected to increased hydrostatic pressure. Thus, hollow, sealed, and stepped-diameter tendons, having sea level atmospheric pressure air therein, are known in the art. These stepped tendons seek to achieve neutral or slightly positive tendon buoyancy, by having an uppermost section with a large outer diameter and positive buoyancy that compensates for the negatively buoyant lower section that has a smaller diameter and thicker wall.

For example, U.S. Pat. No. 6,851,894 issued to Perret et al. discloses a tendon having an upper section of large diameter, an intermediate section of smaller diameter, and a lower section of smallest diameter. The upper section attaches to the TLP. Due to the large diameter of the upper section, that section is positively buoyant. The buoyancy of the upper section compensates for the weight of the heavy lower section so that the overall buoyancy of the tendon is close to neutral.

A drawback of having larger diameter tendons at the TLP is that the TSBs used during installation must in turn be enlarged to fit around the upper tendon section, and the larger tendons have increased surface area subjected to waves and current. Furthermore, if vortex fairings are to be used, they must also be larger.

3. Identification of Features Provided by Some Embodiments of the Invention

A primary object of the invention is to provide a tendon with an uppermost section that has a reduced diameter that allows smaller tendon support buoys and/or vortex fairings to be used, resulting in lower cost.

Another object of the invention is to provide a tendon with an uppermost section that has a reduced diameter that is results in reduced drag due to waves and currents.

Another object of the invention is to provide a tendon with reduced weight in water to reduce loading on the TLP.

Another object of the invention is to provide a stepped tendon, with the benefits thereof, but that retains advantages of having a reduced diameter uppermost section.

SUMMARY OF THE INVENTION

The objects identified above, as well as other features of the invention are incorporated, in a preferred embodiment, in a mooring system for TLPs including tendons having uppermost sections with reduced diameters. Introducing reductions in the diameter of the uppermost sections of the tendons provides reduced drag due to waves and currents and accommodates smaller tendon support buoys and vortex fairings.

The entire tendon is preferably watertight and sealed from the ocean environment. The interior of the tendon is preferably filled with dry air at sea level pressure to reduce weight and increase buoyancy. One or more interior watertight bulkheads are preferably included in the tendon to maintain substantial watertight integrity in the event of a flooding casualty to one or more interior compartments.

Each tendon preferably has an uppermost pipe segment, an intermediate pipe segment axially connected to the bottom of the uppermost segment, and a lower pipe segment axially connected to the bottom of the intermediate pipe segment. The top of uppermost pipe segment is terminated with a length adjustment joint connector assembly that is adapted to connect to the TLP hull. The bottom of the lower pipe segment is terminated with a bottom latch connector assembly that is adapted to be received and locked into a foundation structure on the seabed.

The uppermost pipe segment has an outer diameter that is smaller than the outer diameter of the intermediate pipe segment. The reduced diameter of the uppermost segment provides reduced drag due to waves and currents and accommodates smaller tendon support buoys and vortex fairings, while the larger outer diameter of the intermediate pipe segment is used to increase overall tendon buoyancy. The lower pipe segment has an outer diameter that is smaller than the outer diameter of the intermediate pipe segment. The smaller outer diameter of lower pipe segment provides greater crush resistance to withstand larger hydrostatic pressures at depth.

In a second embodiment, the tendon has only an uppermost pipe segment and a lower pipe segment axially connected below it. The top of the uppermost pipe segment is terminated with a length adjustment joint connector assembly that is adapted to connect to the TLP hull. The bottom of the lower pipe segment is terminated with a bottom latch connector assembly that is adapted to be received and locked into a foundation structure on the seabed.

The uppermost pipe segment has an outer diameter that is smaller than the outer diameter of the lower pipe segment. The reduced diameter of the uppermost pipe segment provides reduced drag due to waves and connects and accommodates smaller tendon support buoys and vortex fairings, while the larger outer diameter of the lower pipe segment is used to increase overall tendon buoyancy.

In a third embodiment, the tendon has an uppermost pipe segment, an upper pipe segment, an intermediate pipe segment, and a lower pipe segment. The top of the uppermost pipe segment is terminated with a length adjustment joint connector assembly that is adapted to connect to the TLP hull. The upper pipe segment is axially connected to the bottom of the uppermost pipe segment, the intermediate pipe segment is axially connected to the bottom of the upper pipe segment, and the lower pipe segment is axially connected to the bottom of the intermediate pipe segment. The bottom of the lower pipe segment is terminated with a bottom latch connector assembly that is adapted to be received and locked into a foundation structure on the seabed.

The uppermost pipe segment has an outer diameter that is smaller than the outer diameter of the adjacent upper pipe segment. The intermediate pipe segment has an outer diameter that is smaller than the outer diameter of the upper pipe segment, and the lower pipe segment has an outer diameter that is smaller than the outer diameter of the intermediate pipe segment. The reduced diameter of the uppermost pipe segment provides reduced drag due to waves and currents smaller tendon support buoys and vortex fairings, while the larger outer diameter of the upper pipe segment is used to increase overall tendon buoyancy. The consecutively smaller outer diameters of the intermediate and lower pipe segments provide greater crush resistance as depth increases.

Although single, double, and triple stepped tendons are described herein, the invention covers tendons with even greater numbers of steps, provided the uppermost pipe segment (defined by its top connection to a length adjustment joint or other TLP connector) has a smaller outer diameter than at least one of the lower pipe segments and more preferably, the next lower adjacent pipe segment.

BRIEF DESCRIPTION OF THE DRAWINGS

The invention is described in detail hereinafter on the basis of the embodiments represented in the accompanying figures, in which.

DESCRIPTION OF THE PREFERRED EMBODIMENT OF THE INVENTION

Figure 1:
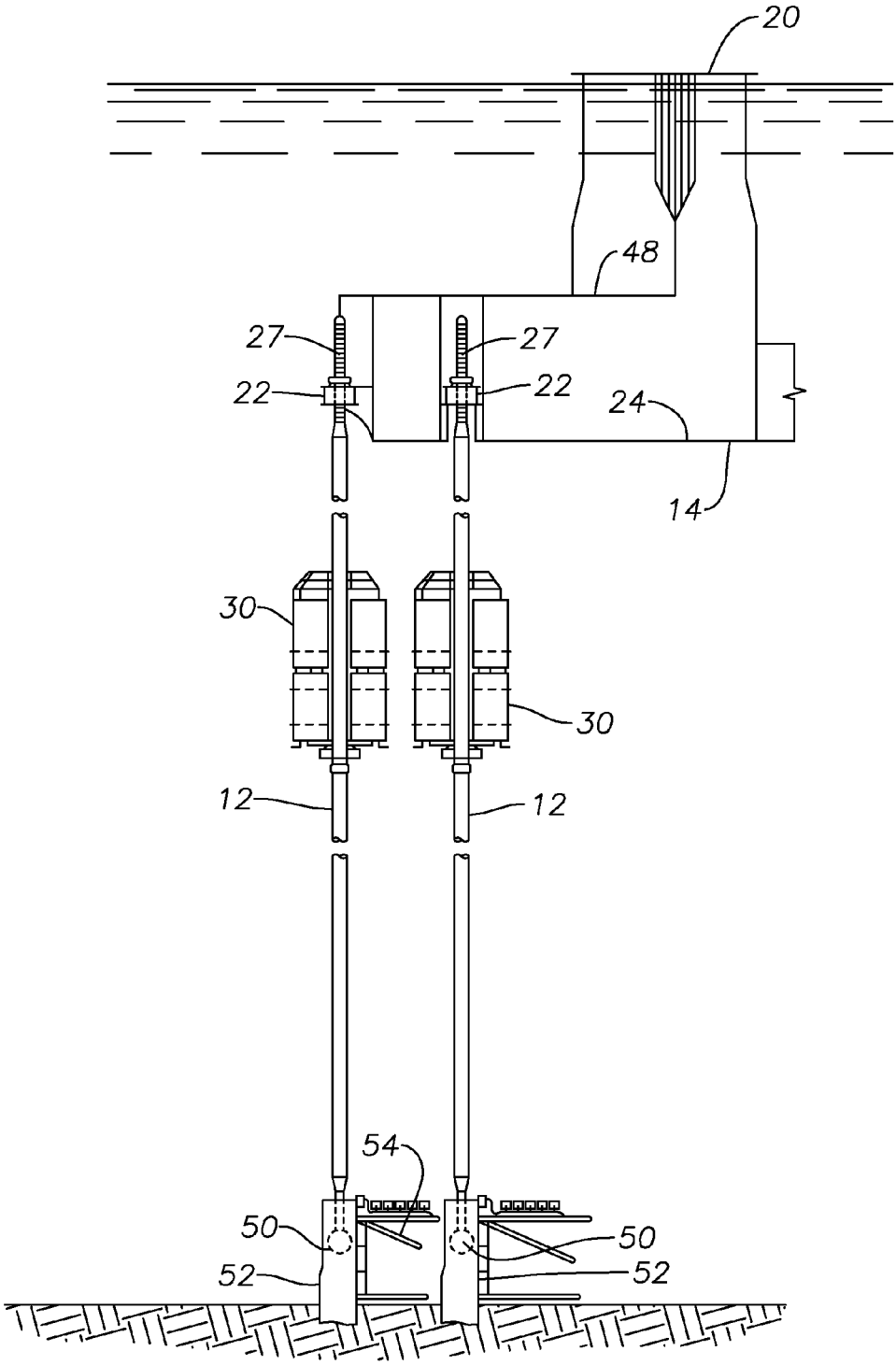
Fig. 1 (Prior Art)
FIG. 1 is a side view of typical prior art tendons for mooring a TLP.
Figure 2:
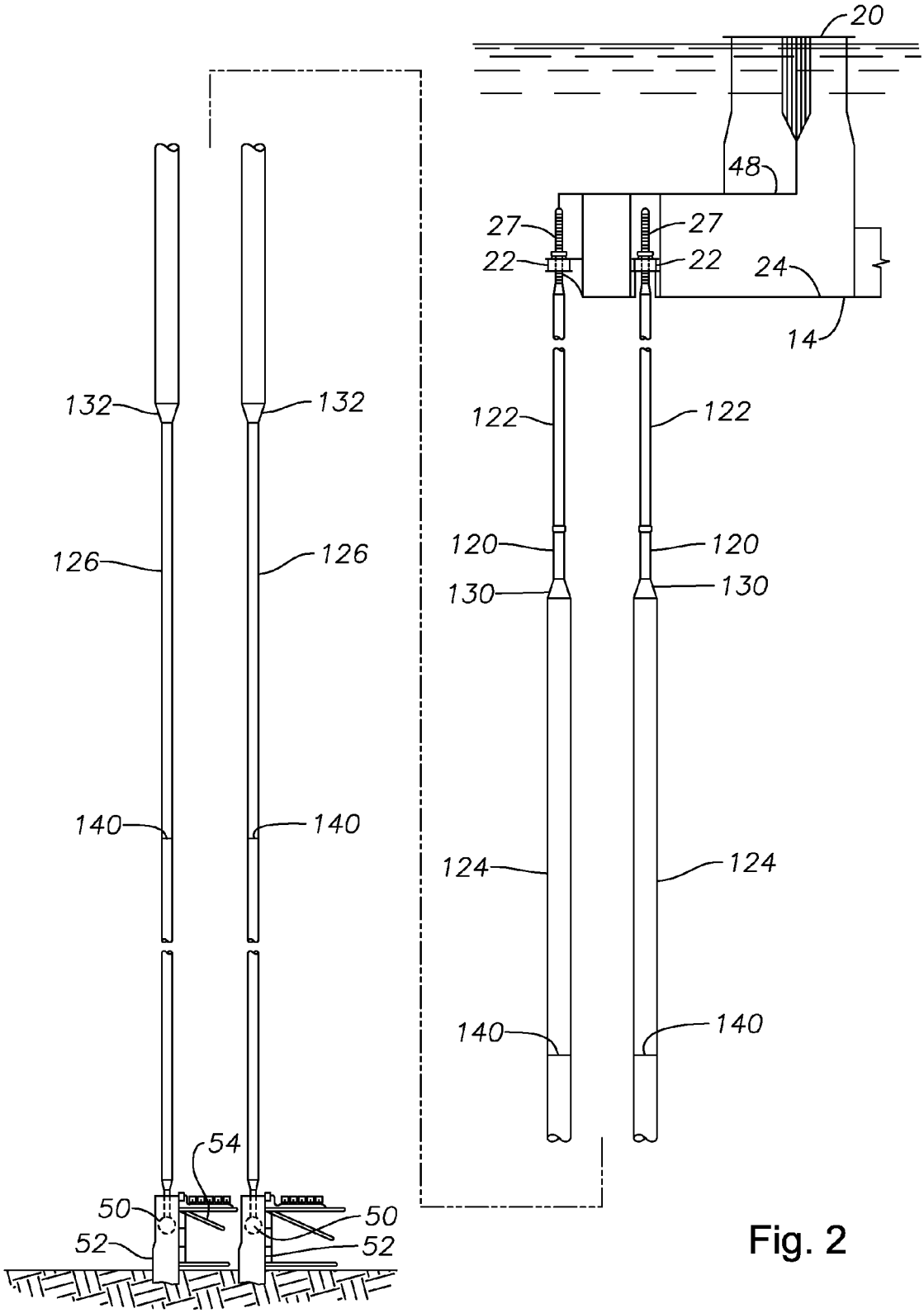
FIG. 2 is a side view of stepped tendons according to one embodiment of the invention, having an uppermost pipe segment of a first outer diameter, an intermediate pipe segment of a second outer diameter larger than the first outer diameter of the uppermost pipe segment, and a lower pipe segment of a third diameter less than the second outer diameter of the intermediate pipe segment.

FIG. 2 illustrates a tendon 120 according to a preferred embodiment of the invention. Tendon 120 has an uppermost pipe segment 122, an intermediate pipe segment 124 axially connected to the bottom of the uppermost segment 122, and a lower pipe segment 126 axially connected to the bottom of the intermediate pipe segment 124. The top of uppermost pipe segment 122 is terminated with a connector assembly 27, commonly referred to as a length adjustment joint (LAJ), that is arranged and designed to connect to the TLP hull 14. The bottom of the lower pipe segment 126 is terminated with a connector assembly 50, commonly referred to as a bottom latch assembly, that is arranged and designed to be received and locked into a piling 52 or other foundation structure on the seabed. The length adjustment joint 27 and the bottom latch assembly 50 are well known in the prior art and are thus not discussed further herein.

"Pipe segment" as used herein refers to a generally continuous portion of the tendon of a given outer diameter. A pipe segment may, however, have varying wall thicknesses and may be constructed of shorter lengths of pipe fastened together, as is typical in tendon construction. "Pipe Segment" is not intended to include either the upper or lower connector assemblies 27, 50.

The entire tendon 120 is preferably watertight and sealed from the ocean environment. The interior of tendon 120 is preferably filled with dry air at sea level pressure to reduce weight and increase buoyancy. One or more interior watertight bulkheads 140 are preferably included in tendon 120 to prevent flooding of the entire tendon 120 should a leak occur.

The outer diameter and wall thickness is selected for each point along the length of tendon 120 to carry tension from the buoyant and partially submerged TLP (which consists of a nominal tension plus tension variations due to functional and environmental loads), to maintain a necessary tendon stiffness, to achieve a desired buoyancy, and to withstand the crushing forces of the surrounding sea. Crushing force becomes more significant as the depth and hydrostatic pressure increases. At depths greater than around 1,000 meters, D/t of tendon 120 are preferably less than 30.

In a preferred embodiment, uppermost pipe segment 122 has an outer diameter that is smaller than the outer diameter of intermediate pipe segment 124. Uppermost pipe segment 122 is connected to intermediate pipe segment 124 by a short transition piece 130, although a longer transition piece with more a gradual change in diameter may be used. The reduced diameter of the uppermost segment 122 of the tendon 120 provides reduced drag due to waves and currents and accommodates smaller tendon support buoys and vortex fairings. The larger outer diameter of the intermediate pipe segment is used to increase overall tendon buoyancy. Lower pipe segment 126 has an outer diameter that is smaller than the outer diameter of intermediate pipe segment 124. The smaller outer diameter of lower pipe segment 126 provides greater crush resistance to withstand larger hydrostatic pressures at depth. Lower pipe segment 126 may have a larger, equal, or smaller outer diameter compared to the uppermost pipe segment 122 outer diameter. Lower and intermediate pipe segments 126, 124 are joined by a transition piece 132. The length adjustment joint 27 may have a smaller diameter than uppermost pipe segment 122, but it is not considered to be part of the uppermost pipe segment 122.

For example, a steel tendon for use at a depth of 4375 feet and 144 foot TLP hull draft may have an uppermost pipe segment 122 about 200 feet tall with an outer diameter of 36 inches and a wall thickness of 1.70 inches (D/t≈21), an intermediate pipe segment 124 about 1970 feet tall with an outer diameter of 44 inches and wall thickness along the upper third of 1.33 inches (D/t≈33) and the lower two-thirds of 1.44 inches (D/t≈30.5), and a lower pipe segment 126 about 2025 feet tall with an outer diameter of 36 inches and a wall thickness along the upper half of 1.50 inches (D/t=24) and the lower half of 1.55 inches (D/t≈23.2). Transition pieces 130, 132 are preferably about 3.5 feet tall each.

Figure 3:
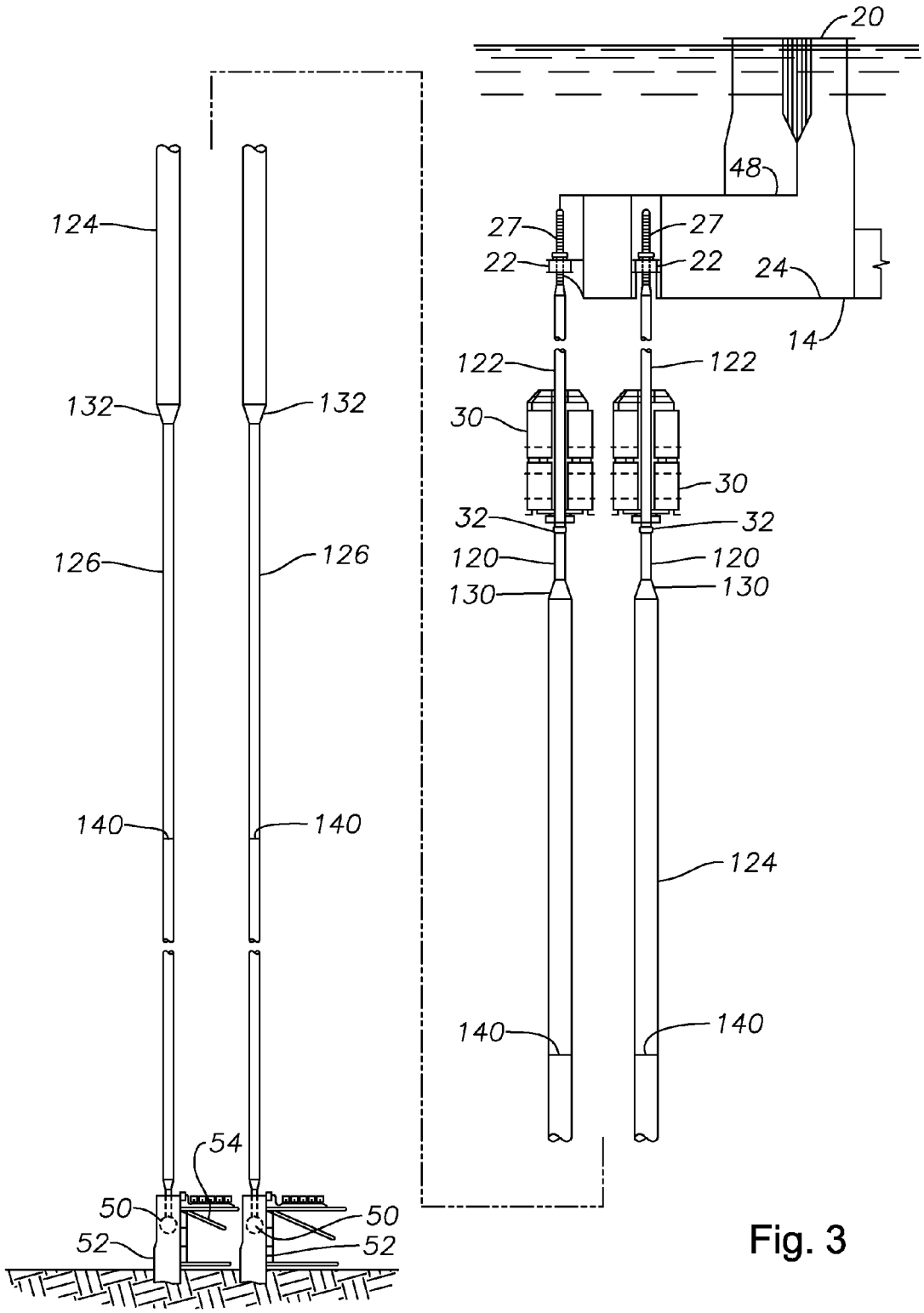
FIG. 3 is a side view of the stepped tendons of FIG. 2 shown with attached tendon support buoys.

FIG. 3 illustrates tendons 120 of FIG. 2, where tendons 120 are equipped with tendon support buoys 30. TSBs 30 are preferably connected to tendons 120 at special forgings 32 with pin grooves, where the TSBs are latched in place. However, other methods of attachment may be used. TSBs 30 are preferably open bottom air cans, although other types of buoys or flotation modules may be used as appropriate.

Figure 4:
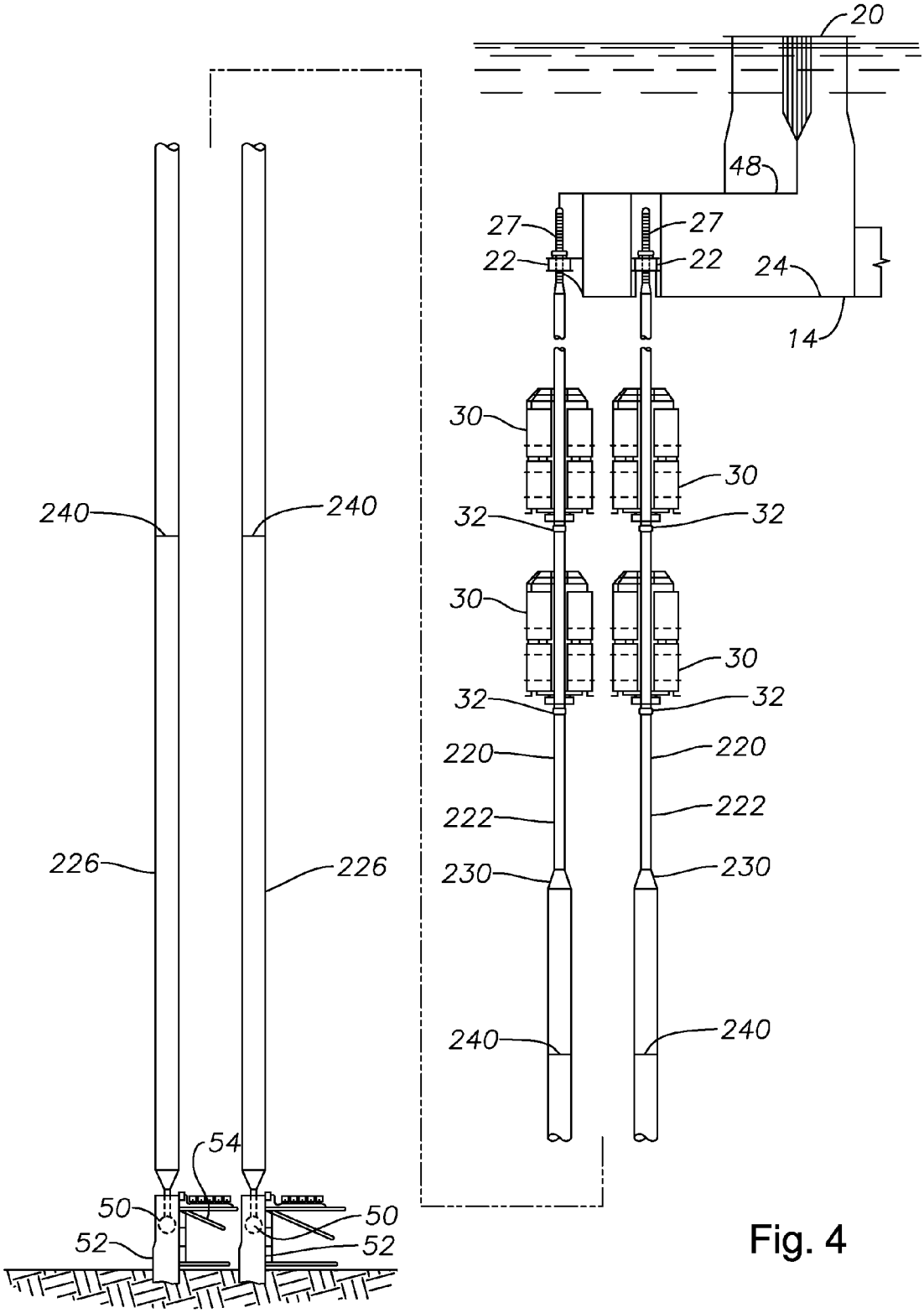
FIG. 4 is a side view of a tendon according to a second embodiment of the invention having an uppermost pipe section of a first outer diameter and a lower pipe section of a second outer diameter larger than the first outer diameter of the uppermost pipe segment.

FIG. 4 illustrates a tendon 220 according to a second embodiment of the invention. Tendon 220 has an uppermost pipe segment 222 and a lower pipe segment 226. The bottom of uppermost pipe segment 222 and the top of lower pipe segment 226 are axially joined by a transition piece 230. The top of uppermost pipe segment is terminated with LAJ connector assembly 27 that is arranged and designed to connect to the TLP hull 14. The bottom of the lower pipe segment 226 is terminated with a bottom latch connector assembly 50 that is arranged and designed to be received and locked into a piling 52 or other foundation structure on the seabed.

The entire tendon 220 is preferably watertight and sealed from the ocean environment. The interior of tendon 220 is preferably filled with dry air at sea level pressure to reduce weight and increase buoyancy. One or more interior watertight bulkheads 240 are preferably included in tendon 220 to prevent flooding of the entire tendon 220 should a leak occur.

The outer diameter and wall thickness is selected for each point along the length of tendon 220 to carry tension from the buoyant and partially submerged TLP (which consists of a nominal tension plus tension variations due to functional and environmental loads), to maintain a necessary tendon stiffness, to achieve a desired buoyancy, and to withstand the crushing forces of the surrounding sea. Crushing force becomes more significant as the depth and hydrostatic pressure increases. At depths greater than around 1,000 meters, D/t of tendon 220 are preferably less than 30.

In the embodiment of FIG. 4, uppermost pipe segment 222 has an outer diameter that is smaller than the outer diameter of lower pipe segment 226. The reduced diameter of the uppermost segment 222 of tendon 220 provides reduced drag due to waves and currents and accommodates smaller tendon support buoys and vortex fairings. The larger outer diameter of the lower pipe segment 226 is used to increase overall tendon buoyancy.

FIG. 4 illustrates tendons 220 each equipped with two tendon support buoys 30 in tandem, although any number of TSBs may be used as appropriate. TSBs 30 are preferably connected to tendons 220 at special forgings 32 with pin grooves, where the TSBs are latched in place. However, other methods of attachment may be used. TSBs 30 are preferably open bottom air cans, although other types of buoys or flotation modules may be used as appropriate.

Figure 5:
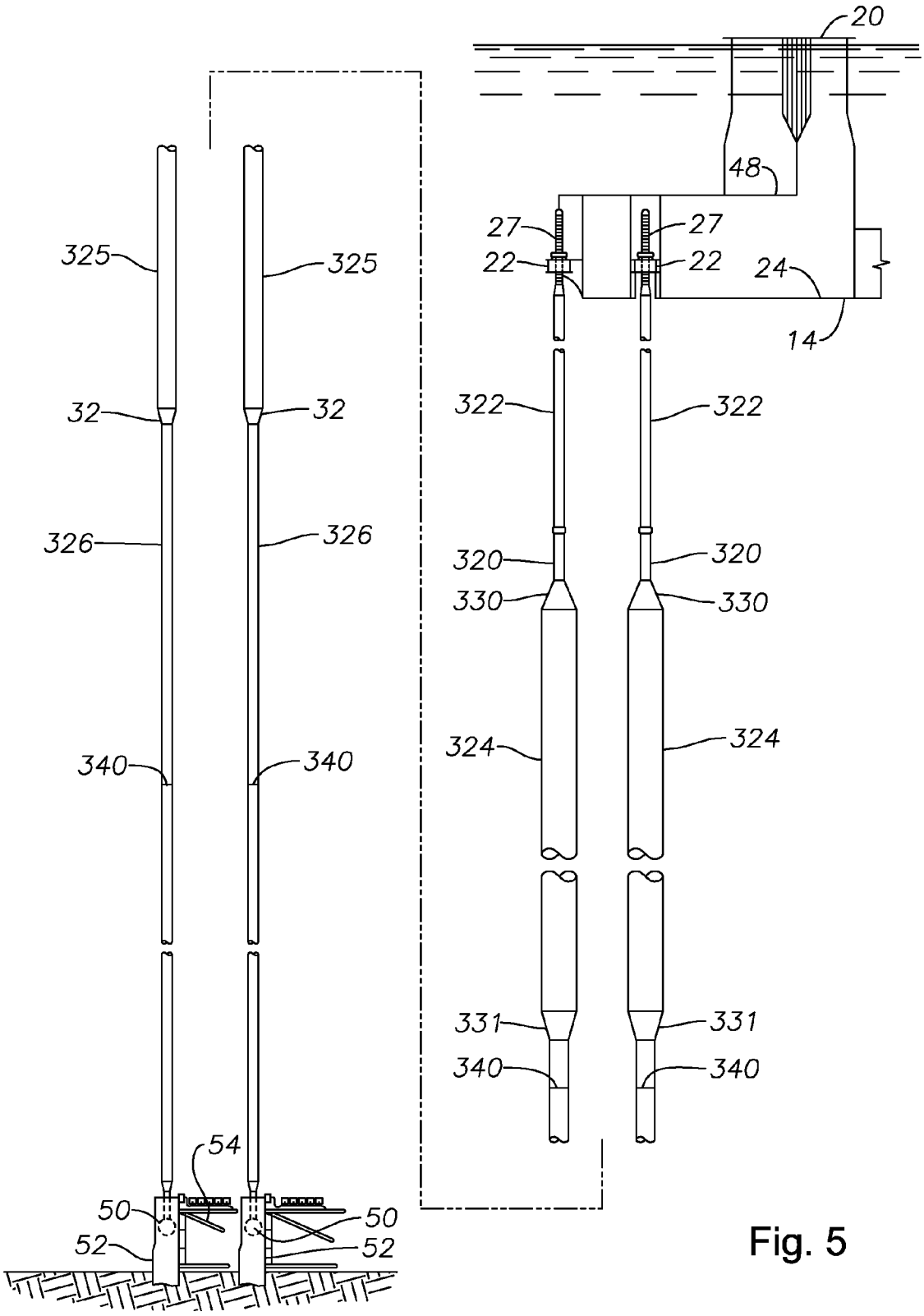
FIG. 5 is a side view of a tendon according to a third embodiment of the invention having an uppermost pipe segment of a first outer diameter, an upper pipe segment of a second outer diameter greater than the first outer diameter of the uppermost pipe segment, an intermediate pipe segment of a third diameter less than the second outer diameter of the upper segment, and a lower pipe segment of a fourth outer diameter less than the third outer diameter of the intermediate pipe segment.

FIG. 5 illustrates a tendon 320 according to a third embodiment of the invention. Tendon 320 has an uppermost pipe segment 322, an upper pipe segment 324, an intermediate pipe segment 325, and a lower pipe segment 326. The bottom of uppermost pipe segment 322 and the top of upper pipe segment 324 are axially joined by a transition piece 330. The bottom of upper pipe segment 324 and the top of intermediate pipe segment 325 are joined by a transition piece 331, and the bottom of intermediate pipe segment 325 and the top of lower pipe segment 326 are joined by a transition piece 332. The top of uppermost pipe segment 322 is terminated with LAJ connector assembly 27 that is arranged and designed to connect to the TLP hull 14. The bottom of the lower pipe segment 326 is terminated with a bottom latch connector assembly 50 that is arranged and designed to be received and locked into a piling 52 or other foundation structure on the seabed.

The entire tendon 320 is preferably watertight and sealed from the ocean environment. The interior of tendon 320 is preferably filled with dry air at sea level pressure to reduce weight and increase buoyancy. One or more interior watertight bulkheads 340 are preferably included in tendon 320 to prevent flooding of the entire tendon 320 should a leak occur.

The outer diameter and wall thickness is selected for each point along the length of tendon 320 to carry tension from the buoyant and partially submerged TLP (which consists of a nominal tension plus tension variations due to functional and environmental loads), to maintain a necessary tendon stiffness, to achieve a desired buoyancy, and to withstand the crushing forces of the surrounding sea. Crushing force becomes more significant as the depth and hydrostatic pressure increases. At depths greater than around 1,000 meters, D/t of tendon 320 are preferably less than 30.

In the embodiment of FIG. 5, uppermost pipe segment 322 has an outer diameter that is smaller than the outer diameter of upper pipe segment 324. The reduced diameter of the uppermost segment 322 of tendon 320 provides reduced drag due to waves and currents and accommodates smaller tendon support buoys and vortex fairings. The larger outer diameter of the upper pipe segment 324 is used to increase overall tendon buoyancy. The consecutively smaller outer diameters of the intermediate and lower pipe segments 324, 325 provide greater crush resistance as depth increases.

Although single, double and triple stepped tendons are described herein, the invention covers tendons with even greater numbers of steps, provided the uppermost pipe segment (defined by its top connection to a length adjustment joint or other TLP connector) has a smaller outer diameter than at least one of the lower pipe segments and more preferably, the next lower adjacent pipe segment.

The Abstract of the Disclosure is written solely for providing the United States Patent and Trademark Office and the public at large with a means by which to determine quickly from a cursory inspection the nature and gist of the technical disclosure, and it represents solely a preferred embodiment and is not indicative of the nature of the invention as a whole.

While some embodiments of the invention have been illustrated in detail, the invention is not limited to the embodiments shown; modifications and adaptations of the above embodiment may occur to those skilled in the art. Such modifications and adaptations are in the spirit and scope of the invention claimed herein:

What is claimed is:

1. A tendon (120) for tensilely mooring a floating body to a foundation member (52) disposed at a bed of a body of water, the tendon comprising:

an uppermost pipe segment (27) characterized by a connector outer diameter and having a top end and a bottom end and arranged and designed for connection to said floating body beneath the surface of said body of water;

a first pipe segment (122) characterized by a first outer diameter and having a top end and a bottom end, said top end of said first pipe segment connected to said bottom end of said uppermost pipe segment;

a second pipe segment (124) characterized by a second outer diameter greater than said first outer diameter of said first pipe segment and having a top end and a bottom end, said top end of said second pipe segment axially connected to said bottom end of said first pipe segment; and a lower connector assembly (50) coupled to said bottom end of said second pipe segment and arranged and designed for connecting to said foundation member.

2. The tendon of claim 1 wherein:

said lower connector is connected to said bottom end of said second pipe segment.

3. The tendon of claim 1 further comprising:

a transition piece (130) disposed between and axially connecting said bottom end of said first pipe segment and said top end of said second pipe segment.

4. The tendon of claim 1 wherein:

said tendon is hollow defining an interior; and the interior of said hollow tendon is sealed from said body of water and contains air approximately at one atmosphere of pressure.

5. The tendon of claim 4 further comprising:

a watertight bulkhead (140) disposed in the interior of said hollow tendon that divides the interior of said hollow tendon into at least two compartments.

6. The tendon of claim 1 further comprising:

a buoy (30) removably connected to said first pipe segment.

7. The tendon of claim 1 further comprising:

a third pipe segment (126) characterized by a third outer diameter less than said second outer diameter of said second pipe segment and having a top end and a bottom end, said top end of said third pipe segment axially connected to said bottom end of said second pipe segment, said lower connector assembly coupled to said bottom end of said third pipe segment.

8. The tendon of claim 7 wherein:

said lower connector is connected to said bottom end of said third pipe segment.

9. The tendon of 7 further comprising:

a first transition piece (130) disposed between and connecting said bottom end of said first pipe segment and said top end of said second pipe segment; and a second transition piece (132) disposed between and connecting said bottom end of said second pipe segment and said top end of said third pipe segment.

10. The tendon of 7 further comprising:

a fourth pipe segment characterized by a fourth outer diameter less than said third outer diameter of said third pipe segment and having a top end and a bottom end, said top end of said fourth pipe segment axially connected to said bottom end of said third pipe segment, said lower connector assembly coupled to said bottom end of said fourth pipe segment.

11. The tendon of claim 10 wherein:

said lower connector is connected to said bottom end of said fourth pipe segment.

12. The tendon of claim 10 further comprising:

a first transition piece (130) disposed between and connecting said bottom end of said first pipe segment and said top end of said second pipe segment;

a second transition piece (132) disposed between and connecting said bottom end of said second pipe segment and said top end of said third pipe segment; and a third transition piece disposed between and connecting said bottom end of said third pipe segment and said top end of said fourth pipe segment.

13. The tendon of claim 1 wherein:

said first outer diameter is greater than said connector outer diameter.

14. A tendon (120) for tensilely mooring a floating body to a foundation member (52) disposed at a bed of a body of water, the tendon comprising:

an uppermost connector pipe segment (27) characterized by a connector outer diameter and having a top end and a bottom end and arranged and designed for connecting to said floating body beneath the surface of said body of water;

an upper pipe segment (122) characterized by a first outer diameter and having a top end and a bottom end, said top end of said upper pipe segment connected to said bottom end of said uppermost connector pipe segment;

an upper transition piece (130) characterized by a frustoconical shape with a top end of said first outer diameter and a bottom end of a second outer diameter greater than said first outer diameter, said top end of upper transition piece axially connected to said bottom end of said upper pipe segment;

an intermediate pipe segment (124) characterized by said second outer diameter and having a top end and a bottom end, said top end of said intermediate pipe segment axially connected to said bottom end of said upper transition piece;

a lower transition piece (132) characterized by an inverted frustoconical shape having a top end of said second outer diameter and a bottom end of a third outer diameter less than said second outer diameter, said top end of said lower transition piece axially connected to said bottom end of said intermediate pipe segment;

a lower pipe segment (126) characterized by said third outer diameter and having a top end and a bottom end, said top end of said lower pipe segment axially connected to said bottom end of said lower transition piece; and a lower connector assembly (50) coupled to said bottom end of said lower pipe segment and arranged and designed for connecting to said foundation member.

15. The tendon of claim 14 wherein:

said tendon is hollow defining an interior; and the interior of said hollow tendon is sealed from said body of water and contains air approximately at one atmosphere of pressure.

16. The tendon of claim 15 further comprising:

a watertight bulkhead (140) disposed in the interior of said hollow tendon that divides the interior of said hollow tendon into at least two compartments.

17. The tendon of claim 14 further comprising:

a buoy (30) removably connected to said upper pipe segment.

18. The tendon of claim 14 wherein:

said first outer diameter is greater than said connector outer diameter.

19. A stepped tendon (120) for tensilely mooring a floating tension leg platform to a foundation member (52) disposed at a bed of a body of water, the tendon comprising:

an uppermost pipe segment (27) connected to said tension leg platform beneath the surface of said body of water, said uppermost pipe segment characterized by a first outer diameter, a top end, and a bottom end;

an upper pipe segment (122) characterized by a second outer diameter greater than said first outer diameter, a top end and a bottom end, said top end of said upper pipe segment connected to said bottom end of said uppermost pipe segment; and at least one lower pipe segment (124) having a top end connected to said bottom end of said upper pipe segment and characterized by a third outer diameter greater than said second outer diameter, said at least one lower pipe segment having a bottom end coupled to said foundation member.

* * * * *

UNITED STATES PATENT AND TRADEMARK OFFICE

CERTIFICATE OF CORRECTION

PATENT NO. : 7,422,394 B2
APPLICATION NO. : 11/383350
DATED : September 9, 2008
INVENTOR(S) : Koon et al.

It is certified that error appears in the above-identified patent and that said Letters Patent is hereby corrected as shown below:

Title page, item [73], delete "Modec International, Inc.", insert --Modec International, LLC.--;

Title page, item [73], delete "Sea Engineering, Inc.", insert --Sea Engineering Associates, Inc.--;

Signed and Sealed this

Ninth Day of June, 2009

JOHN DOLL
*Acting Director of the United States Patent and Trademark Office*